US005303845A

United States Patent [19]

Osawa

[11] Patent Number: 5,303,845

[45] Date of Patent: Apr. 19, 1994

[54] BEER SELF-SERVICE SYSTEM

[75] Inventor: Kokichi Osawa, Saitama, Japan

[73] Assignee: Yugen Gaisha Yakiniku Restaurant Daiko, Saitama, Japan

[21] Appl. No.: 927,597

[22] Filed: Aug. 10, 1992

[30] Foreign Application Priority Data

Aug. 14, 1991 [JP] Japan ..... 3-228789

[51] Int. Cl.[5] ..... B67D 5/62

[52] U.S. Cl. ..... 222/1; 62/390; 222/23; 222/32; 222/36; 222/39; 222/71; 222/77; 222/146.1; 222/399

[58] Field of Search ..... 222/1, 2, 146.1, 146.6, 222/14, 23, 32, 33, 36, 37, 40, 55, 61, 71, 64–66, 77, 394, 399; 62/389, 390, 393

[56] References Cited

U.S. PATENT DOCUMENTS

| | | | |
|---|---|---|---|
| 2,362,104 | 11/1944 | Smith | 222/146.6 X |
| 2,598,751 | 6/1952 | Berkowitz et al. | 62/390 X |
| 2,618,938 | 11/1952 | Booth et al. | 62/390 X |
| 2,646,667 | 7/1953 | Kromer | 62/390 |
| 2,771,752 | 11/1956 | Tennant | 62/393 X |
| 3,428,218 | 2/1969 | Coja | 222/39 X |
| 3,599,843 | 8/1971 | Johnston | 222/399 |
| 3,625,399 | 12/1971 | Heisler | 222/399 X |
| 3,751,642 | 8/1973 | Todd et al. | 222/23 X |
| 3,863,724 | 2/1975 | Dalia, Jr. | 222/77 X |
| 4,198,626 | 4/1980 | Rauscher | 222/39 X |
| 4,212,068 | 7/1980 | Hoyt | 222/36 X |
| 4,225,057 | 9/1980 | Horn | 222/36 X |
| 4,433,795 | 2/1984 | Maiefski et al. | 222/14 |
| 4,869,396 | 9/1989 | Horino et al. | 222/61 |
| 4,997,012 | 3/1991 | Kuziw | 222/77 X |
| 5,007,560 | 4/1991 | Sassak | 222/61 X |

*Primary Examiner*—Kevin P. Shaver
*Attorney, Agent, or Firm*—Notaro & Michalos

[57] ABSTRACT

An apparatus and method for serving beer at proper $CO_2$ content and proper temperature for best taste, comprises a draft tower for distributing beer at the proper gas content and at the proper temperature. A plurality of beer barrels connected in series are in turn connected to the draft tower by a pipeline. A $CO_2$ gas cylinder is connected to the barrels for supplying gas at an elevated pressure sufficient to move the beer from the barrels along the pipeline to the tower. A heater is provided for heating the barrel to an elevated temperature above the proper temperature for taste, so that the gas content in the barrel does not rise above the proper gas content under the influence of possibly elevated pressure needed to convey the beer. Near or at the draft tower, the beer is recooled to the proper temperature and thus served at a proper temperature and with the proper gas content.

17 Claims, 2 Drawing Sheets

BEER SELF-SERVICE SYSTEM

FIELD AND BACKGROUND OF THE INVENTION

The present invention relates in general to a beer serving system, and more particularly, to a system of serving draft-beer from a barrel through draft towers into jugs, mugs, glasses or the like. Specifically, the invention concerns improvements in the extensibility of beer supplying pipelines in the system, which can be installed in a beer hall, bar, restaurant or the like, while maintaining the taste of the beer.

A system is known, for example, which includes draft towers for dispensing beer, a beer barrel, pipelines connecting the draft towers to the beer barrel, and a gas cylinder connected to the beer barrel for pressurizing the barrel to force the beer through the pipelines and out to the draft towers.

In such a system, the beer at 0.5% by weight $CO_2$ content in the barrel is cooled down to about 5° C., which is believed to be the best gas content and temperature for taste, and at which to drink the beer. The beer in the barrel is subjected to a pressure which is a little higher than 1.0 atmosphere, namely 1.2–1.5 atmosphere, by means of a carbonic acid gas cylinder, for forcing the beer through the pipelines. If the pressure of the gas cylinder is higher than approximately 1.5 atmospheres and this pressure is applied to the surface of the beer for a long time, too much $CO_2$ will dissolve into the beer and this will increase its $CO_2$ content to more than 0.5%. If the beer is warmed to higher than 5° C. under such pressurization, the ideal gas content may be maintained. This cannot be done however, without degrading the beer's taste due to the higher than ideal temperature for the beer.

A pressure of 1.5 atmospheres, however, cannot force the beer very far along the pipelines. The extension of the pipelines between the beer barrel or barrels, and the draft towers, thus, is at most about 2 meters for the known system.

Because of such short supply lines, the prior art systems rely on manpower to carry the beer from the draft towers to the customers. Waitresses and waiters must pass among chairs and tables in bars, beer halls and restaurants having such systems, while carrying the beer in heavy jugs filled at the draft towers. The known systems thus lack efficient beer supplying ability.

SUMMARY OF THE INVENTION

The present invention comprises a method and apparatus for facilitating the serving of beer. The apparatus of the invention is a tightly sealed system comprising draft towers from which beer is dispensed, one or more beer containing barrels, pipelines connected between the draft towers and the barrel for transferring beer, and a pressurized carbonic acid gas cylinder connected to the barrel for supplying the beer. The barrel is either warmed or cooled, depending on the temperature of the surroundings of the barrel, so that the beer attains the best tasting $CO_2$ content, but is under a sufficiently high pressure for pushing the beer in the system. The beer, at or near the draft towers, is then cooled down to such a temperature as to render the beer best tasting to drink when it is dispensed, i.e., 5° C.

It is therefore an object of the invention to provide an apparatus and method for serving beer in which the supply lines can be extended by increasing the pressure of a $CO_2$ gas cylinder forming part of the system without adversely effecting the taste of the beer. Because high $CO_2$ pressurization of the beer in the barrel increases gas content and degrades the taste, the barrel is adjusted in temperature either by warming or cooling, depending on the surrounding temperature, whereby a desired gas content of the beer, namely about 0.5%, is maintained irrespective of the high pressure, while the temperature adjusted beer is readjusted, usually by cooling, after it moves away from the barrel region so that it is fed at a draft tower under desired gas content and temperature conditions.

According to a further feature of the invention, the barrel is divided into plural barrels which are connected in series between the gas cylinder and the pipelines so that a passage of carbonic acid gas is provided therethrough and high pressure is applied in one direction in the series.

It is, therefore, another object of the invention to provide an apparatus and method for a beer serving system wherein the barrel is divided into two or more barrels, or replaced by barrels connected in series and to which are applied high pressure in one direction, by the gas cylinder through a connecting passage. In this way, when a barrel or barrels other than the one connected directly to the pipelines, runs out of beer, the empty barrel can be taken from the supply line and exchanged with a new one without discontinuing the beer supply, and further securely avoiding incursion of free air into the pipelines during and after changing of the empty barrel.

According to a further feature of the invention, the serving system is provided with a detector for weighing the barrel connected to the gas cylinder, comparing the weight to a predetermined value and, if the weight is the same as the predetermined value, activating a warning.

It is, therefore, another object of the invention to provide an apparatus and method for serving beer wherein the time when an empty barrel should be changed is indicated by an alarm system and therefore, an unexpected interruption of the beer supply is avoided and also the incursion of free air into the pipelines is avoided.

According to another feature of the invention, each pipeline in the system is provided with a flow meter to which calculators are connected by electric wires. One of the calculators is fixed near the draft tower and another near a billing station. A reset button for resetting the calculators to zero is provided near the billing station.

It is, therefore, another object of the invention to provide an apparatus and method for serving beer wherein billing and accounting become easy by displaying the amount of beer drunk by a customer from his particular draft tower and displaying a corresponding charge at the billing station.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

Figure 1:
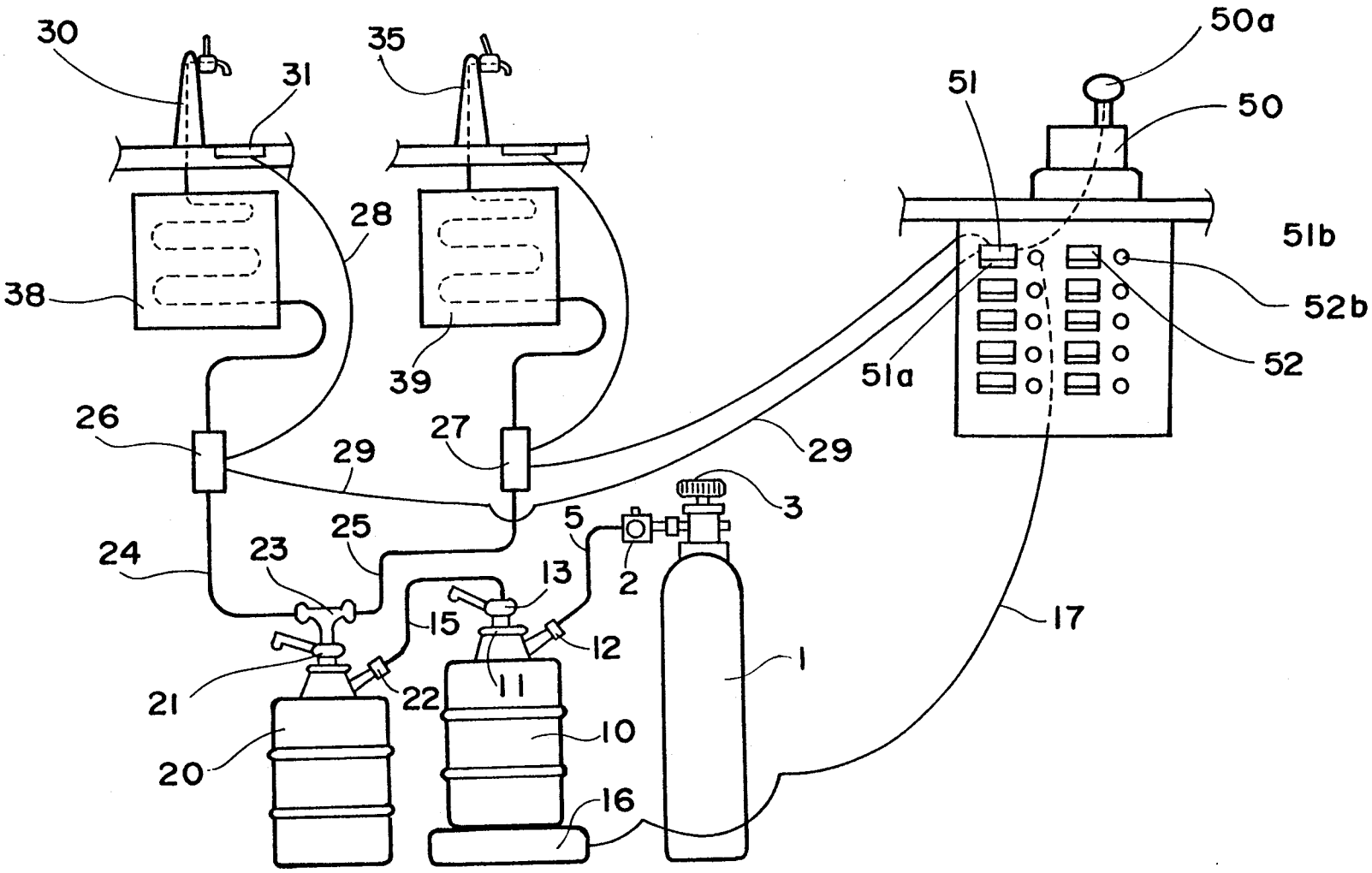
FIG. 1 is a schematic view showing the beer serving system of the present invention.

FIG. 1 shows the scheme for a beer serving system of the present invention with only a single gas supply line 5 connected to a gas cylinder 1, wherein two barrels 10, 20 are connected in series, two draft towers 30, 35 are used and two pipelines 24, 25 are connected therebetween with their accessories, for simplicity. As many as ten displays 51 are shown at a billing station 50, assuming ten draft tower pairs are installed in the whole system. Thus in an actual embodiment of the invention several lines are connected to a single or plural gas cylinder(s). In other words, FIG. 1 shows as many displays as might be actually installed at the billing station, while it shows the barrels, pipelines, draft towers, other displays and their accessories on a single supply line only for simplicity sake.

Figure 2:
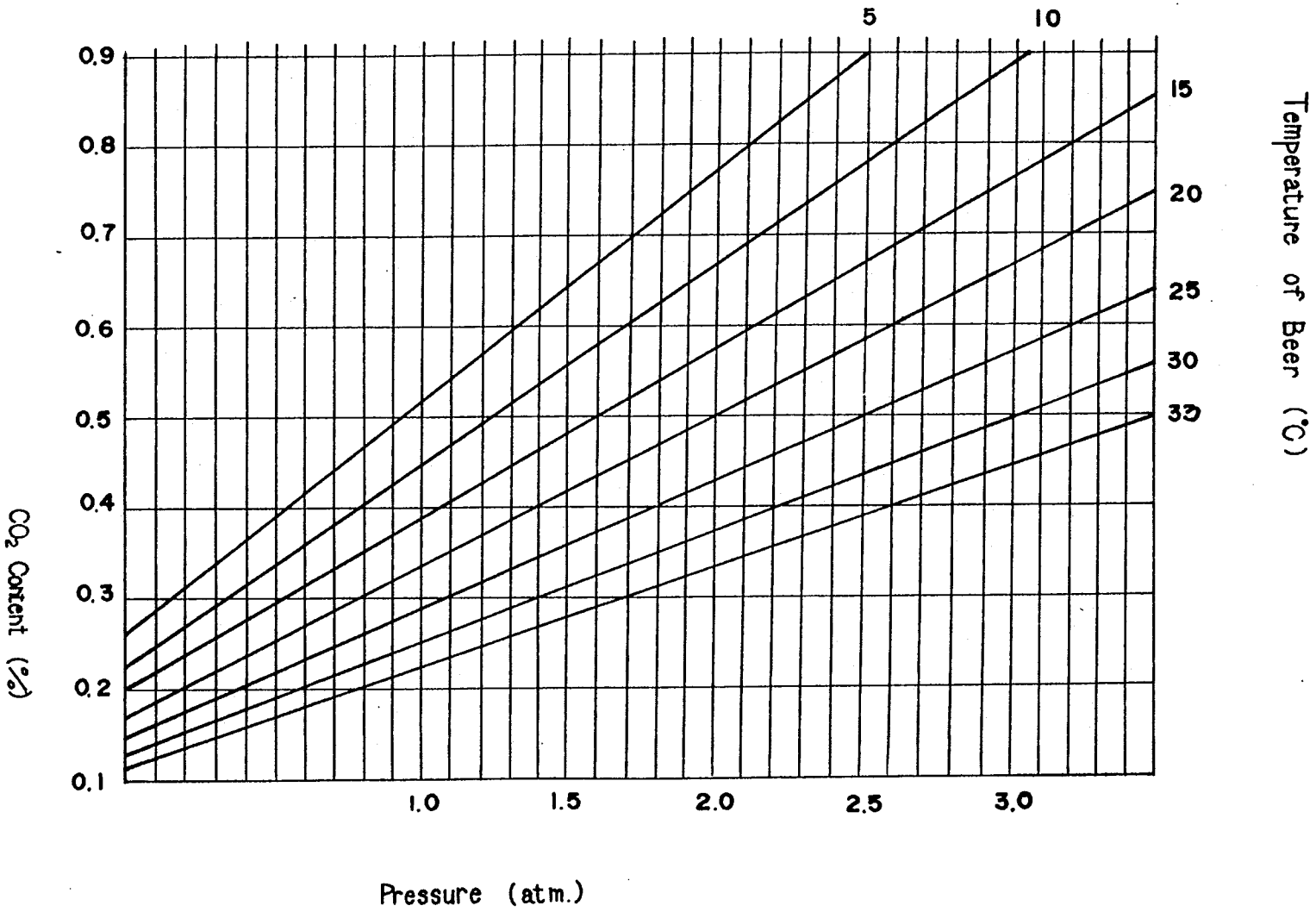
FIG. 2 is a graph plotting an equilibrium condition for carbon dioxide content under different pressures and at different temperatures.

FIG. 2 is an equilibrium graph showing the influence of atmospheric pressurization and temperature on the density of carbonic acid gas content in beer. As shown, when the illustrated pressure is applied, the beer's $CO_2$ gas content cannot be maintained at any level, and therefore the temperature is increased as the pressure is increased. However, the relationship between the temperature rise and the $CO_2$ gas content decrease is not in direct proportion but in a gradually decreasing proportion. In other words, the higher the temperature is, the slower the increasing rate of $CO_2$ gas content becomes. Accordingly, the higher the pressure is, the higher the temperature must be. For example, under 1.0 atmospheres, 0.5% gas content can be attained at 5° C., however, if the pressure is increased to 1.2 atmospheres, the beer must be warmed up to 10° C. Similarly, if 1.5 atmospheres are applied , the beer must be warmed up to 15° C., if 2.0 atmospheres, to 20° C., if 2.5 atmospheres, to 25° C., if 3.0 atmospheres, to 30° C. and if 4.0 atmospheres, up to 40° C. (not shown). If the supply lines are short and yet a high pressure is applied, the pushing force is too great and a large amount of bubbles are discharged at the draft tower. If, on the contrary, the supply lines are long and yet only low pressure is applied, the pushing force is not sufficient and the beer may not be supplied at all. Thus the force must be provided at the right level in accordance with the length of the supply lines and for a longer supply line, a higher pressure must be applied where the temperature is to be adjusted to be warmer. However, too much warming of the beer not only causes overloads at the coolers on the pipelines used to refrigerate the beer before the outlets, but also causes degradation of the beer itself and therefore, there may be a maximum temperature and accordingly, a maximum pressurization which limits the extensibility of the supply lines.

Referring again to FIG. 1, barrel 10 is connected to the downstream end of a gas supply line 5 which has an upstream end connected by a connecter to a $CO_2$ gas cylinder 1. The gas cylinder 1 has a regulator 2 and a stopcock 3, while the barrel 10 has a plug 11, a connecting end 12 for the supply line 5, and a connecting end 13 connected to a short tube 15 which connects the barrel 10 to another barrel 20 that is connected to the pipelines 24 and 25. Barrel 20 is adjacent the barrel 10, and like barrel 10, has a plug 21, a connecting end 22 for the short tube 15 and a connecting end 23, connected to an end of the pipeline. The plug 21 and the connecting end 22 are provided under the same standards as those of plug 11 and connecting end 12 of the barrel 10, which can be directly connected to the connecter of supply line 5 of the gas cylinder 1. These barrels 10 and 20 are connected to each other by the short tube 15.

The barrel 10 connected to the gas cylinder 1 is placed on a platform scale and heater/cooler 16. The platform 16 has a detector which transmits a signal upon detection of a predetermined weight, for example an empty weight of the barrel 10 when the beer therein has run out. The signal is transmitted via an electric wire 17 and operates an alarm lamp **51*b* or an alarm buzzer (not shown), near the billing station 50. The heating and/or cooling function of the barrel may be provided by any known means and at a location other than platform 16**.

The connecting end 23 of the downstream barrel 20 is bifurcated, and to each end of which pipelines 24 and 25 are connected respectively. The other ends of the pipelines 24, 25 are, in turn, connected to the draft towers 30 and 35, respectively. The pipelines 24 and 25 can be extended as long as required from the barrel 20 to the draft towers 30, 35. The magnitude of pressurization to be set is decided in accordance with the length of the supply lines.

The force needed to push the beer, in fact, is dependent not only on the magnitude of the pressurization, but also on other factors in the system, for example, by the number of pipelines connected to a barrel and the inner diameter of the pipelines. Generally, pipelines are preferably not to be tri- or more furcated from the connecting end 23. This is because the supplying force from the gas cylinder 1 for dispensing beer at the draft towers 30 and 35 is likely to be dispersed or weakened . The inner diameter of the pipelines 24, 25 may be determined according to, for instance, the Williams-Hazen formula, and is usually 6 mm or 8 mm.

The pressurization magnitude is within the range of 1.6–4.0 atmospheres and accordingly, a temperature of about 15°–40° C. is needed, to push the beer through the system of several meters or more without bubbling at the outlets or degrading the taste of the beer. The pressurization magnitude to attain the ideal 0.5% $CO_2$ gas content in the above range is decided in accordance with FIG. 2. Automatic control of the degree of warming is also possible by using a computer in the system, programmed to control the heater 16 accordingly.

Coolers are installed either at the draft towers 30, 35, their accessories, and/or pipelines 24, 25. For example, refrigerators 38 and 39 receive pipelines 24, 25 just below the draft towers 30, 35 so that the beer is cooled quickly down to 5° C. before it is released at the draft towers 30, 35 irrespective of its temperature in the barrels 10 and 20. The beer of 0.5% $CO_2$ gas content in the barrel 10 will not change its gas content in other regions of the system such as along the supply lines or near the draft towers where it is drastically cooled down. In other words, unless the beer in the barrels 10 and 20 is cooled, it may be cooled in other regions throughout the system. This is because $CO_2$ gas applied under high pressure on the surface of the beer in the barrel, if maintained for several hours, may dissolve into the beer through the beer's surface. Insufficient surface contact of the gas to the beer exists in the pipelines and other regions beyond the barrels, so that the danger of $CO_2$ increase due to pressure is only at the barrel and only there is it necessary to warm the beer.

Flow meters 26, 27 are connected in the pipeline 24, 25. These flow meters 26, 27 are, for example, devices having impellers which revolve as liquid flows through, to measure the passing quantity thereof. Further, electric wires 28, 29 extend from the flow meter 26. Wire 28 is connected to an integrating meter or display 31 fixed on the table at the foot of the draft tower 30 for indicating the amount of released beer, while another electric wire 29 is connected to another integrating meter or display 51 near the billing station 50 to indicate the same amount. Thus a customer may clear his account relying on the display by the integrating meter 31 belonging to his draft tower 30 or at the billing station 50, while a charger at the billing station 50 can charge the customer in accordance with the indicated quantity of released beer at the integrating meter 51. The indications shown in the integrating meters 31, 51, can be reindicated at display 50*a* of the billing station if operated so by the charger. Once the balance is cleared, the charger pushes a reset button 51*a* belonging to the integrating meter 51 and the integrating meters 31, 51 near the draft tower 30 and the billing station 50 respectively are zeroed out and are prepared for the next customer. Thus the electric wires 28, 29 are bifurcated from a flow meter 26 respectively to be connected to integrating meters 31, 51 respectively for indication of the amount of released beer.

Below is an explanation of how to change an empty barrel on the supply line. In this explanation, the beer serving system comprises two or more barrels that are connected in series and the carbonic acid gas passage is connected therethrough with pressurization from one end of the series. First, both a stopcock 3 of the gas cylinder 1 and a stopcock 22 of the barrel 20 are shut and the empty barrel 10 is separated from the supply line and a new fully charged barrel 10 is connected to the gas cylinder 1 as before, and then the stopcock 22 of the barrel 20 and a connecting end 13 are connected by the short tube 15 and then the stopcock 3 and the plug 11 are opened. Thus the empty barrel is displaced from the supply line and a new fully charged barrel 10 can be reset on the supply line without disturbing the beer supply even if, during the barrel change, a customer takes beer from the barrel 20 through the draft towers 30, 35. This is because the pressurized barrel 20 which is connected to the pipelines 24, 25 but separated from the barrel 10 and accordingly from the gas cylinder 1, still retains pressurization within the barrel 20 which is sufficient enough to push the beer for one or two customers. After changing the barrel 10, some beer from the barrel 20 may have been used while changing the barrel 10, however, no carbonic gas may enter into the pipelines 24, 25 as long as some beer remains in the barrel 20. Because new beer in the barrel 10 continues to enter into the barrel 20, the beer in the barrel 20 retains its amount just before the reconnection of the fully charged barrel 10 on the supply line. The $CO_2$ pressure in the barrel 20 is decreased as much as the beer therein is supplied, however, this decrease is merely temporary and is corrected as the new barrel 10 is connected to the gas cylinder 1 from which again the high pressure is applied through the opened stopcock 3, the connector or supply line 5, and the short tube 15. In this way, the system can continue working for the customers who may open the draft towers to take beer from the system during the barrel changing operation.

While specific embodiments of the invention have been shown and described in detail to illustrate the application of the principles of the invention, it will be understood that the invention may be embodied otherwise without departing from such principles.

What is claimed is:

1. A method for serving beer at a draft tower and at a selected $CO_2$ gas content and a serving temperature, comprising:

pressurizing a barrel containing beer using $CO_2$ at a selected pressure which is above 1.6 atmosphere and which is thus sufficient to supply the beer along a pipeline and through the draft tower which is connected to the barrel through the pipeline;

changing the temperature of the barrel to a selected temperature at which beer in the barrel retains the gas content under the selected pressure, the selected temperature being different from the serving temperature; and cooling the beer to the serving temperature, adjacent the tower so that beer dispensed by the draft tower is at the serving temperature and has the selected $CO_2$ gas content.

2. An apparatus according to claim 1, wherein the temperature control means warms the beer in the barrel to the selected temperature which is greater than the serving temperature.

3. A method according to claim 1, including connecting a plurality of barrels in series between a $CO_2$ gas cylinder for supplying the selected pressure, and the pipeline.

4. A method according to claim 1, including weighing the barrel and activating an alarm when the weight of the barrel falls below a selected level, indicating insufficient beer in the barrel.

5. A method according to claim 1, wherein the serving temperature is approximately 5° C. and the selected $CO_2$ gas content is approximately 0.5% by weight $CO_2$.

6. A method according to claim 1, including measuring a flow of beer along the pipeline and displaying an amount of beer distributed from the tower, based on the flow of beer.

7. A method according to claim 6, including displaying the amount of beer dispensed at a billing station spaced from the tower.

8. A method according to claim 6, including weighing the barrel and activating an alarm when the weight of the barrel falls below a selected level, indicating insufficient beer in the barrel.

9. An apparatus for serving beer at a selected $CO_2$ gas content and a serving temperature comprising:

means for dispensing beer at the selected gas content and the serving temperature;

at least one beer containing barrel;

a pipeline connected between the barrel and the dispensing means for transferring beer to the dispensing means from the barrel;

a pressurized $CO_2$ gas cylinder connected to the barrel for pressurizing the barrel;

a regulator operatively connected to the gas cylinder for providing a selected pressure level which is sufficient to supply beer from the barrel, along the pipeline and the dispensing means;

temperature control means for warming the barrel to a selected temperature at which beer in the barrel retains the selected gas content under the selected pressure level, the temperature control means warming the beer in the barrel to the selected temperature which is greater than the serving temperature; and cooling means spaced from the barrel and operatively connected to at least one of the pipeline and dispensing means for cooling beer to be dispensed from the dispensing means to the serving temperature.

10. An apparatus according to claim 9, including at least one additional barrel connected in series to said first mentioned barrel, between said gas cylinder and said pipeline, gas from said cylinder passing in series between said first mentioned and additional barrels.

11. An apparatus according to claim 10, including means for weighing the first mentioned barrel and alarm means for activating an alarm when a weight measured by the weighing means falls to a selected value indicating the first mentioned barrel has insufficient beer therein.

12. An apparatus according to claim 9, including a flow meter in the pipeline, means for calculating the billing for beer supplied by the dispensing means and display means connected to the flow meter and positioned at the dispensing means and at the billing means, for displaying an amount of beer dispensed from the dispensing means.

13. An apparatus according to claim 12, including a reset button at the billing means for resetting the indicator means to zero after billing for an amount of beer dispensed has taken place.

14. An apparatus according to claim 9, including:

weighing means for weighing the barrel; and alarm means connected to the weighing means for activating an alarm when the weighing means senses a weight for the barrel indicative of insufficient beer in the barrel.

15. An apparatus according to claim 14, including a flow meter in the pipeline, means for calculating the billing for beer supplied by the dispensing means and display means connected to the flow meter and positioned at the dispensing means and at the billing means, for displaying an amount of beer dispensed from the dispensing means.

16. An apparatus for serving beer at a selected $CO_2$ gas content and a serving temperature, comprising:

means for dispensing beer at the selected $CO_2$ gas content and the serving temperature;

at least one beer containing barrel spaced from the dispensing means;

a pipeline connected between the barrel and the dispensing means for transferring beer to the dispensing means from the barrel;

a pressurized $CO_2$ gas cylinder connected to the barrel for pressurizing the barrel;

a regulator operatively connected to the gas cylinder for providing a selected pressure level of above 1.6 atmosphere on beer in the pipeline, which is sufficient to supply beer from the barrel, along the pipeline and the dispensing means, the selected pressure level causing beer in the barrel to be at a different $CO_2$ gas content than the selected $CO_2$ gas content when the beer is at the serving temperature;

temperature control means for warming the or cooling the barrel to a selected temperature at which is different from the serving temperature, and at which beer in the barrel retains the selected $CO_2$ gas content under the selected pressure level; and cooling means spaced from the barrel and operatively connected to at least one of the pipeline and dispensing means for cooling beer to be dispensed from the dispensing means to the serving temperature.

17. An apparatus according to claim 16, wherein the temperature control means warms the beer in the barrel to the selected temperature which is greater than approximately 5° C.

* * * * *